United States Patent [19]

Fortmann

[11] Patent Number: 4,832,422

[45] Date of Patent: May 23, 1989

[54] ONE-PIECE DRAWER WITH INTEGRAL GUIDE STRUCTURE

[75] Inventor: Robert C. Fortmann, Palatine, Ill.

[73] Assignee: Carter-Hoffman Corporation, Mundelein, Ill.

[21] Appl. No.: 93,738

[22] Filed: Sep. 8, 1987

[51] Int. Cl.[4] ..... A47B 88/00

[52] U.S. Cl. ..... 312/330 SM; 312/34 MR; 312/350

[58] Field of Search ..... 312/341 AR, 330 R, 330 SM, 312/350

[56] References Cited

U.S. PATENT DOCUMENTS

| | | | |
|---|---|---|---|
| 1,666,333 | 4/1928 | Isoyama | 312/330 |
| 1,866,464 | 7/1932 | Hallowell et al. | 312/330 X |
| 2,579,753 | 12/1951 | Norquist | 312/330 SM |
| 3,315,834 | 4/1967 | Nemlich | 312/330 R |
| 3,752,553 | 8/1973 | Bildahl et al. | 312/330 R |
| 4,190,306 | 2/1980 | Litchfield | 312/330 R |
| 4,403,817 | 9/1983 | Aidar | 312/330 SM X |

FOREIGN PATENT DOCUMENTS

| | | | |
|---|---|---|---|
| 8107288 | 10/1986 | Switzerland | 312/330 SM |

*Primary Examiner*—Joseph Falk

*Attorney, Agent, or Firm*—Wood, Dalton, Phillips Mason & Rowe

[57] ABSTRACT

An improvement in a drawer of the type having a bottom wall and a peripheral wall structure extending upwardly from the bottom wall and defining in conjunction therewith a storage space. The peripheral wall structure has a front wall, a rear wall and first and second laterally spaced side walls, each extending between the front and rear walls. The improvement resides in each of the side walls being a single piece and having an integrally formed guide slot for cooperation with spaced elements on a cabinet with which the drawers are associated. The spaced elements move in the slots and support and guide sliding movement of the drawer. In a preferred form, each of the guide slots has a laterally opening, U-shape in cross section and the guide slots on each drawer open laterally away from each other. Preferably, the drawer is used in combination with a cabinet bounding a storage space and having an opening in its front wall to permit selective movement of the drawer into and out of the space. In a preferred form, laterally spaced guide elements are provided on the cabinet for reception in the guide slots. Each guide element comprises an elongate rail, preferably made from a plastic material such as DELRIN.

6 Claims, 1 Drawing Sheet

ONE-PIECE DRAWER WITH INTEGRAL GUIDE STRUCTURE

BACKGROUND OF THE INVENTION

1. Field of the Invention

This invention relates to slidable drawers as used in food service cabinets and, more particularly, to a drawer with integrally formed structure for guiding sliding movement of the drawer into and out of the cabinet.

2. Background Art

In the food service industry, holding cabinets are generally equipped with structure to control both temperature and humidity to cook and/or preserve foods within the cabinet. Sliding drawers are commonly used to facilitate placement of food in and removal of food from the controlled environment within the cabinet.

There are several problems that designers of drawers for food service equipment contend with that need not be addressed when designing drawers for use in other environments. In one conventional drawer construction, rollers are utilized on one of the drawer and associated cabinet and a cooperating guide rail is used on the other of the drawer and cabinet. With the rail on the cabinet, the roller bears on a downwardly facing surface on the rail and thereby supports the drawer and rolls against the surface as the drawer is pushed in and withdrawn from the cabinet. While this type of system generally accounts for smooth movement of the drawers, it has inherent problems and disadvantages.

The rollers must normally be lubricated. The hot conditions within the cabinet may cause the lubricant to evaporate or be thinned, thereby causing it to flow into the drawers and possibly over the foods contained therein. Normal maintenance of the cabinet also requires periodic relubrication of the rollers.

Another problem with roller/rail systems is that they are prone to jamming and may require periodic adjustment. Adjustments may be difficult and are often performed inconsistently from one drawer to the next, thereby preventing interchange of drawers. Further, during the process of removing and replacing of the drawers, as during cleaning, the drawer adjustments may be disturbed.

Another problem is that the drawer slide structure is relatively intricate, thereby providing surfaces for the deposition and accumulation of lubricant and food. Cleaning of the drawers and the drawer slide structure is thereby made difficult and frequently the overall structure is less sanitary than is desirable.

Another problem that has plagued the industry has been the difficulty in manufacturing the drawers. Typically, the drawers are formed from stainless steel sheet stock with a peripheral wall surface extending upwardly from a bottom drawer wall. It is conventional to form the drawers from numerous parts, which are welded or riveted together. This is a relatively involved and thereby time consuming and expensive operation. Additionally, one of the rail and cooperating roller structure is bolted to the walls of the drawers, thereby often providing additional projecting structure for the accumulation of food with a resulting complication of the cleaning process.

SUMMARY OF THE INVENTION

The present invention is specifically directed to overcoming the above enumerated problems in a novel and simple manner.

According to the invention, an improvement is provided in a drawer of the type having a bottom wall and a peripheral wall structure extending upwardly from the bottom wall and defining in conjunction therewith a storage space. The peripheral wall structure has a front wall, a rear wall and first and second laterally spaced side walls, each extending between the front and rear walls.

The improvement resides in each of the side walls being a single piece and having an integrally formed guide slot for cooperation with spaced elements on a cabinet with which the drawers are associated. The spaced elements move in the slots and support and guide sliding movement of the drawer. In a preferred form, each of the guide slots has a laterally opening, U-shape in cross section and the guide slots on each drawer open laterally away from each other.

Preferably, the drawer is used in combination with a cabinet bounding a storage space and having an opening in its front wall to permit selective movement of the drawer into and out of the space. In a preferred form, laterally spaced guide elements are provided on the cabinet for reception in the guide slots. Each guide element comprises an elongate rail, preferably made from a plastic material such as DELRIN.

Each slot on the drawer is bounded by a downwardly facing surface, which is supported and guided along the cabinet guide rail. The DELRIN rail smoothly guides fore and aft movement of the drawer without the need for rollers and other conventional type guide structures as may require periodic lubrication.

Because the slots and rails have a fixed configuration, no adjustment is required for either. The drawers are interchangeably attached to and removed from their associated cabinet. The inventive drawer naturally seeks centered relationship with the guide rails.

The slot preferably has a sufficient width i.e. on the order of 1 inch, so as to be entirely accessible for thorough cleaning. All corners of that portion of the drawer defining the slots are rounded to avoid tight crevices and the like that tend to trap and accumulate foreign matter. The rail is likewise exposed to be easily cleaned.

Another aspect of the invention is the formation of a least the drawer bottom wall and side walls from a single sheet of metal. The entire drawer is preferably made from a single piece of material that is sufficiently rigid that the front, rear and side walls do not have to be welded or otherwise secured to each other to maintain the drawer shape.

DETAILED DESCRIPTION OF THE DRAWINGS

Figure 1:
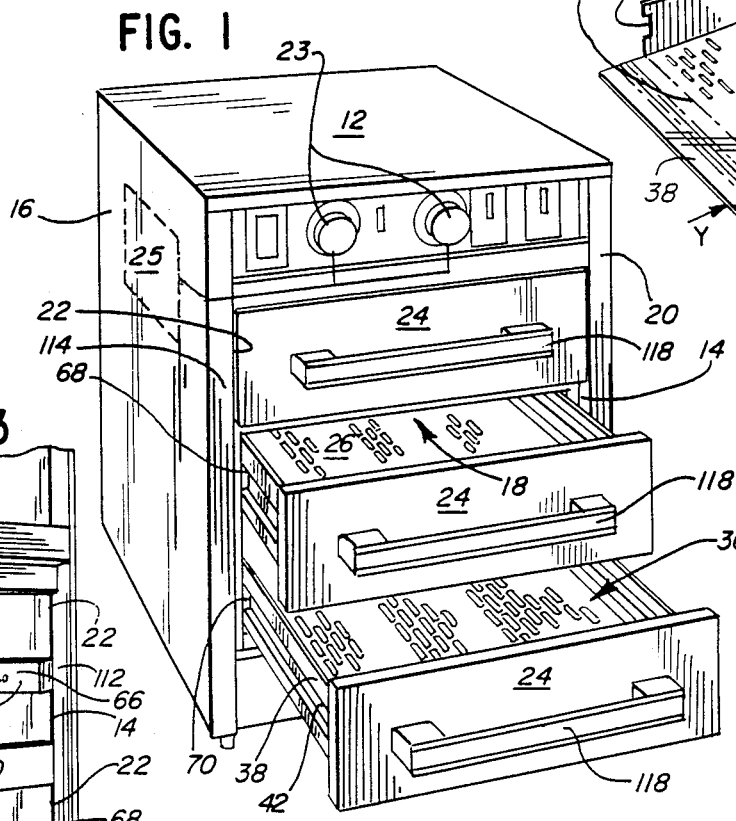
FIG. 1 is a perspective view of a food service cabinet having drawers according to the present invention.

In FIG. 1, a food service cabinet 12 of the type conventionally used for the cooking and/or preservation of foods is shown with the present invention incorporated. The cabinet 12, which has a box-like configuration, consists of a frame 14 with a sheet metal covering 16 enclosing a food storage space at 18. The front wall 20 of the cabinet 12 has vertically spaced openings 22 to facilitate entry into the storage space 18. A column of three like drawers 24 is provided to support foods which are selectively moved into and out of the space 18 by sliding of the drawers 24. Conventional structure is used to establish desired environmental conditions within the space 18. In the depicted device, separate external control knobs 23 are provided, for example, to selectively control humidity and temperature within the cabinet space 18 through a known structure, shown schematically at 25. To maintain the selected conditions within the space 18, the walls of the cabinet 12 are insulated, as by the use of a fiberglass batt core.

Figure 4:
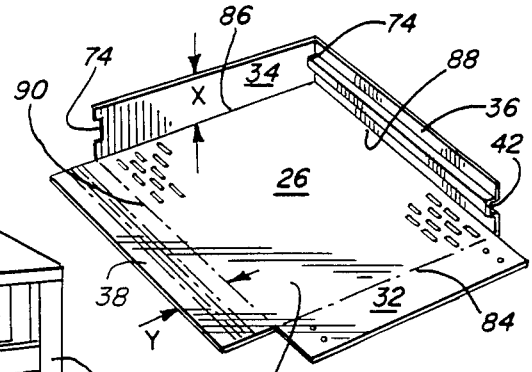
FIG. 4 is a perspective view of a single sheet metal blank partially formed to define one of the drawers.
Figure 2:
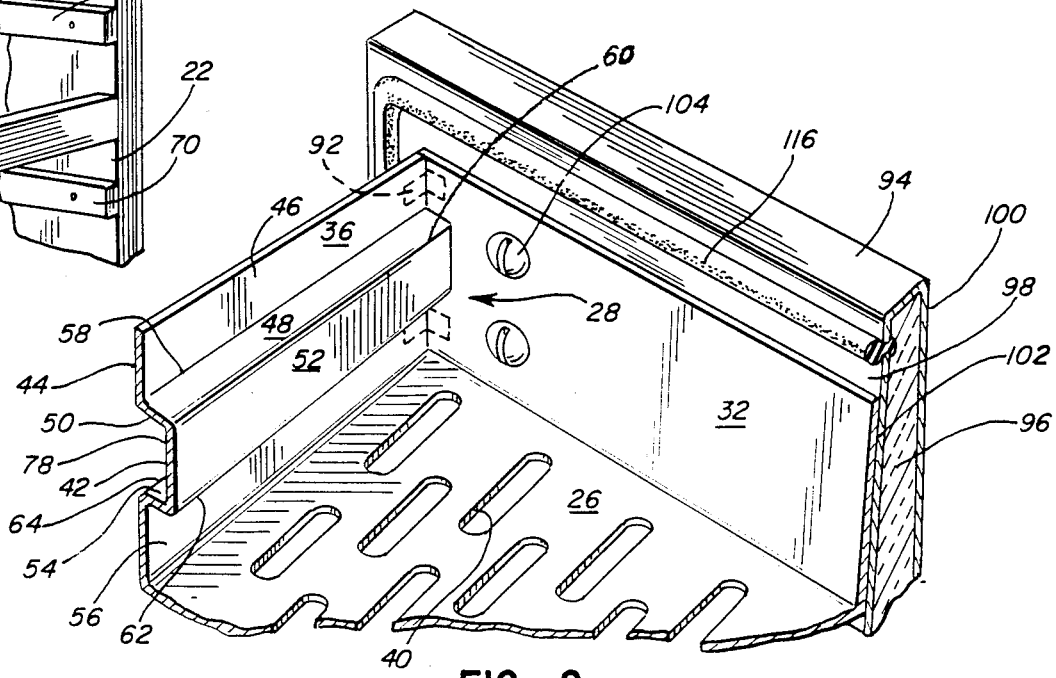
FIG. 2 is an enlarged, fragmentary, perspective view of a front corner of one of the drawers.

The present invention is directed to a readily formable drawer 24 with structure to permit selective sliding movement of each drawer 24 into and out of the space 18. Each drawer 24, as seen in FIGS. 1, 2 and 4, has a rectangular bottom wall 26 and a peripheral wall structure at 28 extending upwardly from the bottom wall 26 and defining in conjunction therewith an upwardly opening storage space 30 for food to be introduced to the space 18. The wall structure 28 consists of a front wall 32, a rear wall 34 and laterally spaced first and second side walls 36, 38 extending between the front and rear walls 32, 34. Each of the front, rear and side walls 32, 34, 36, 38 has a generally rectangular configuration and extends upwardly from the bottom wall 26 at substantially a right angle thereto. The bottom wall 26, which supports the food, has a regularly arranged pattern of oval cutouts 40 to permit upward convection of heated and humidified air through the contents of the drawer 24.

Each side wall 36, 38 has an integrally formed guide slot 42 extending along its entire length. The walls 36, 38 are identically formed and thus discussion herein will be limited to one exemplary wall 36. The wall 36 has a laterally outwardly facing, vertical surface 44 that is interrupted mid-height by the slot 42. The wall 36, below a top portion 46 thereof, is bent laterally inwardly, thereby defining a horizontal wall portion 48 with a downwardly facing surface 50. From wall portion 48, the wall 36 is bent downwardly to define a vertical wall portion 52, from which the wall 52 is return bent to define horizontal wall portion 54, from which the wall 36 is downwardly bent to define bottom wall portion 56 that is aligned with the upper wall portion 46. Each of corner 58, at the juncture of wall portions 46, 48, corner 60, at the juncture of wall portions 48, 52, corner 62, at the juncture of wall portions 52, 54 and corner 64, at the juncture of wall portions 54, 56, is curved so as to avoid tight crevices that tend to trap and accumulate food and other foreign matter, to thereby facilitate cleaning.

Figure 3:
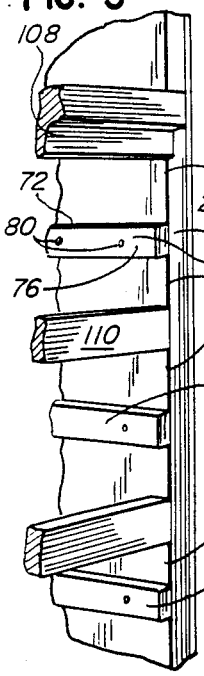
FIG. 3 is a fragmentary, perspective view of guide rails for the drawers on the cabinet.

Each drawer 24 cooperates with a pair of rails 66, 68, 70 attached to the cabinet frame 14, as shown clearly in FIG. 3. Each rail 66, 68, 70 has a rectangular cross section on the order of 1 inch high by $\frac{1}{4}$ inch in width and is received and movable lengthwise within a drawer slot 42. Exemplary rail pair 66 will now be used to describe the cooperation between the rails 66, 68, 70 and drawers 24.

Each rail 66 has an upwardly facing guide surface 72 which, with the rail 66 in the slot 42, aligns beneath and supports the downwardly facing surface 50 on the drawer wall portion 48. The rear wall 34 of the drawer 24 has a cut-out 74 at each side thereof to permit passage of the rails 66 into the slots 42 from the rear of the drawers 24. The mutually facing surfaces 76 (one shown in FIG. 3) of the rails 66 are spaced apart a slightly greater distance than the spacing of the outwardly facing surfaces 78 at the base of each slot 42 so that the rails 66 can be directed without binding simultaneously into the spaced slots 42 on the drawer 24. Preferably this difference in spacing, for drawer having approximately a 20 inch width, is on the order of $\frac{1}{8}$ of an inch, thereby leaving 1/16 of an inch clearance between the slot surfaces 78 and the rail surfaces 76 on each drawer side. The width of walls 48 is substantially greater than $\frac{1}{8}$ of an inch so that surfaces 50 always remain in overlying relationship with surface 72 on the guide rails regardless of the lateral position of the drawer 24 in the cabinet 12 to thereby prevent the drawers 24 from falling off of the rails 66, 68, 70.

The drawer is readily operably positioned in the cabinet 12 by aligning the rails 66 with their respective cutouts 74 on the rear wall 34 of the drawer 24 and thereafter directing the drawer 24 rearwardly into the cabinet. No adjustment of any kind is necessary and the drawers 34 naturally seek centered relationship between the rails 66, 68, 70.

Preferably, the rails 66 are made from a plastic material such as DELRIN. DELRIN affords a durable, low friction guide surface for each drawer. Each rail 66 is secured to the frame 24 on cabinet 12 by four machine screws 80 having their heads countersunk so as not to protrude laterally beyond the surfaces 76 on the rails 66. This facilitates cleaning and avoids any hindrance to sliding of the drawers over the rails 66.

It can be seen that the inventive structure eliminates the need for guide rollers and the like yet provides interchangeable drawers that are smoothly operable without he requirement of adjustment or lubrication. At the same time, the drawers 24 and the guide rails 66, 68, 70 can be readily removed, cleaned and replaced.

Another aspect of the invention is the formation of the drawers 24 from a single blank of sheet metal stainless steel as, for example, type 304 stainless steel. In FIG. 4, a partially formed blank 82 is shown for one drawer 24. The front wall 32 is folded relative to the bottom wall 26 about fold line 84 so as to make a right angle with the bottom wall 26. The rear wall 34 is similarly folded about line 86. The extension of the front and rear walls 32, 34 from their respective fold lines 84, 86 is the same and indicated by distance X in FIG. 4.

Before side walls 36, 38 are folded relative to the bottom wall 26, the slots 42 are impressed therein. The unformed walls 36, 38 have a dimension from their respective fold lines 88, 90 a distance Y, which is greater than the distance X to compensate for the shortening thereof due to the formation of the slot 42.

The sheet material used to form the drawers 24 is preferably stainless steel of approximately 16 gauge. The walls 32, 34, 36, 38 will thus maintain their relative upright positions without being secured at the corners of the drawers. Optionally, angle braces 92, shown in phantom in FIG. 2, or other structure can be utilized to reinforce the walls as shown at the exemplary juncture between walls 32 and 36.

To facilitate manipulation of each drawer 24 and to insulate the openings 22 provided for each drawer 24 with the drawer closed, a front panel 94 is secured to the front wall 32 of each drawer 24. The panel 94 is preferably formed of stainless steel material and encases a rectangular fiberglass batt 96 so as to define a rearwardly facing wall 98 and a parallel forwardly acing wall 100, which is exposed at the front of the cabinet 12. The rearwardly facing wall 98 facially abuts the forward surface 102 of the drawer wall 32 and is secured thereto as by screws 104. The panel 94 is sufficiently large to cover each drawer opening 22 defined between vertically spaced dividers 108, 110 and upright frame elements 112, 114. To further insulate the cabinet, a heat resistant, silicon gasket 116 is attached to the wall 98 and, with the drawer 24 closed, is captured compressibly between the panel 94 and the cabinet 12. A handle 118 is provided on the front of each panel 94 to be grasped for pulling open each drawer 24.

Manufacture of a drawer according to the present invention involves merely striking out a blank, as in FIG. 4 and strategically bending the blank to define the slots 42 and the peripheral wall structure 28.

I claim:

1. An improved drawer assembly of the type having a drawer with a bottom wall and a peripheral wall structure extending upwardly from the bottom wall and defining in conjunction therewith a storage space, said peripheral wall structure having a front wall, a rear wall and first and second laterally spaced side walls each extending between the front and rear walls, each said side wall having a free top edge and a bottom edge within said storage space, and means for guiding sliding movement of said drawer between a closed position and an open position, the improvement comprising:

each said first and second side walls, front wall, rear wall and bottom wall comprising a single piece of formed sheet metal and each said first and second side walls having a laterally opening U-shaped guide slot formed directly from said single piece of sheet metal extending from front to rear for cooperation with the guiding means to support and guide sliding movement of the drawer in a fore and aft direction relative to the guide elements between said open and closed positions, each said side wall having an inside wall surface bounding said storage space and an outside wall surface extending between the top free edge and bottom edge of the side wall, said outside wall surface being formed to define said guide slot on each said side wall, and being a continuous and uninterrupted formed single layer of said single sheet of metal between the top free edge and bottom edge on each side wall, and said guiding means comprising a cabinet defining a space for reception of said drawer in the closed drawer position and having spaced guide elements for reception in the drawer guide slots and cooperating with the slots to guide movement of the drawer selectively into and out of the cabinet space.

2. The improved drawer according to claim 1 wherein means are provided for connecting the side walls fixedly to the front wall at locations both above and below the guide slot on each side wall.

3. The improved drawer according to claim 1 wherein each said guide element comprises an elongated rail and each said rail comprises a hard plastic material.

4. The improved drawer according to claim 3 wherein said guide slots are each bounded by a downwardly facing surface on the drawer and each guide element has an upwardly facing surface for supporting the downwardly facing drawer surface.

5. The improved drawer according to claim 3 wherein each said guide element is made from DELRIN.

6. The improved drawer according to claim 3 wherein each said guide element has a substantially uniform, rectangular cross-sectional configuration.

* * * * *